US005999071A

United States Patent [19]

Ostertag

[11] Patent Number: 5,999,071

[45] Date of Patent: Dec. 7, 1999

[54] APPARATUS FOR REDUCING VSWR IN RIGID TRANSMISSION LINES

[75] Inventor: Edward L. Ostertag, Manhattan, Ill.

[73] Assignee: Andrew Corporation, Orland Park, Ill.

[21] Appl. No.: 09/127,145

[22] Filed: Jul. 31, 1998

[51] Int. Cl.[6] ..... H01P 3/06; H01P 1/04

[52] U.S. Cl. ..... 333/245; 333/260

[58] Field of Search ..... 333/243, 245, 333/260

[56] References Cited

U.S. PATENT DOCUMENTS 2,955,148 10/1960 Graham et al. ..... 174/88
3,373,242 3/1968 Sewell ..... 174/21
3,955,871 5/1976 Kruger ..... 333/260 X
4,019,162 4/1977 Banning ..... 333/33 X
5,218,326 6/1993 Fleming-Dahl ..... 333/245 X

*Primary Examiner*—Paul Gensler
*Attorney, Agent, or Firm*—Arnold, White & Durkee

[57] ABSTRACT

A rigid, coaxial transmission line is provided which includes a plurality of sections joined by connector assemblies. The transmission line includes a plurality of ordered groups. Each of the ordered groups includes a plurality of equal-length sections. The length of the equal-length sections in each ordered group is selected to reduce the VSWR spikes caused by the connector assemblies. The length of the equal-length sections progressively changes between each of the ordered groups.

16 Claims, 12 Drawing Sheets

| | Number of Sections/Group | | | | | |
|---|---|---|---|---|---|---|
| Section# | 2 | 4 | 6 | 8 | 10 | 12 |
| 1 | 240.0000 | 240.0000 | 240.0000 | 240.0000 | 240.0000 | 240.0000 |
| 2 | 240.0000 | 240.0000 | 240.0000 | 240.0000 | 240.0000 | 240.0000 |
| 3 | 239.7752 | 240.0000 | 240.0000 | 240.0000 | 240.0000 | 240.0000 |
| 4 | 239.7752 | 240.0000 | 240.0000 | 240.0000 | 240.0000 | 240.0000 |
| 5 | 239.5504 | 239.5504 | 240.0000 | 240.0000 | 240.0000 | 240.0000 |
| 6 | 239.5504 | 239.5504 | 240.0000 | 240.0000 | 240.0000 | 240.0000 |
| 7 | 239.3256 | 239.5504 | 239.3256 | 240.0000 | 240.0000 | 240.0000 |
| 8 | 239.3256 | 239.5504 | 239.3256 | 240.0000 | 240.0000 | 240.0000 |
| 9 | 239.1008 | 239.1008 | 239.3256 | 239.1008 | 240.0000 | 240.0000 |
| 10 | 239.1008 | 239.1008 | 239.3256 | 239.1008 | 240.0000 | 240.0000 |
| 11 | 238.8760 | 239.1008 | 239.3256 | 239.1008 | 238.8760 | 240.0000 |
| 12 | 238.8760 | 239.1008 | 239.3256 | 239.1008 | 238.8760 | 240.0000 |
| 13 | 238.6512 | 238.6512 | 238.6512 | 239.1008 | 238.8760 | 238.6512 |
| 14 | 238.6512 | 238.6512 | 238.6512 | 239.1008 | 238.8760 | 238.6512 |
| 15 | 238.4264 | 238.6512 | 238.6512 | 239.1008 | 238.8760 | 238.6512 |
| 16 | 238.4264 | 238.6512 | 238.6512 | 239.1008 | 238.8760 | 238.6512 |
| 17 | 238.2016 | 238.2016 | 238.6512 | 238.2016 | 238.8760 | 238.6512 |
| 18 | 238.2016 | 238.2016 | 238.6512 | 238.2016 | 238.8760 | 238.6512 |
| 19 | 237.9768 | 238.2016 | 237.9768 | 238.2016 | 238.8760 | 238.6512 |
| 20 | 237.9768 | 238.2016 | 237.9768 | 238.2016 | 238.8760 | 238.6512 |
| 21 | 237.7520 | 237.7520 | 237.9768 | 238.2016 | 237.7520 | 238.6512 |
| 22 | 237.7520 | 237.7520 | 237.9768 | 238.2016 | 237.7520 | 238.6512 |
| 23 | 237.5272 | 237.7520 | 237.9768 | 238.2016 | 237.7520 | 238.6512 |
| 24 | 237.5272 | 237.7520 | 237.9768 | 238.2016 | 237.7520 | 238.6512 |
| 25 | 237.3024 | 237.3024 | 237.3024 | 237.3024 | 237.7520 | 237.3024 |
| 26 | 237.3024 | 237.3024 | 237.3024 | 237.3024 | 237.7520 | 237.3024 |
| 27 | 237.0776 | 237.3024 | 237.3024 | 237.3024 | 237.7520 | 237.3024 |
| 28 | 237.0776 | 237.3024 | 237.3024 | 237.3024 | 237.7520 | 237.3024 |
| 29 | 236.8527 | 236.8527 | 237.3024 | 237.3024 | 237.7520 | 237.3024 |
| 30 | 236.8527 | 236.8527 | 237.3024 | 237.3024 | 237.7520 | 237.3024 |
| 31 | 236.6279 | 236.8527 | 236.6279 | 237.3024 | 236.6279 | 237.3024 |
| 32 | 236.6279 | 236.8527 | 236.6279 | 237.3024 | 236.6279 | 237.3024 |
| 33 | 236.4031 | 236.4031 | 236.6279 | 236.4031 | 236.6279 | 237.3024 |
| 34 | 236.4031 | 236.4031 | 236.6279 | 236.4031 | 236.6279 | 237.3024 |
| 35 | 236.1783 | 236.4031 | 236.6279 | 236.4031 | 236.6279 | 237.3024 |
| 36 | 236.1783 | 236.4031 | 236.6279 | 236.4031 | 236.6279 | 237.3024 |
| 37 | 235.9535 | 235.9535 | 235.9535 | 236.4031 | 236.6279 | 235.9535 |
| 38 | 235.9535 | 235.9535 | 235.9535 | 236.4031 | 236.6279 | 235.9535 |

(inches)

FIG. 9a

| | Number of Sections/Group | | | | | |
|---|---|---|---|---|---|---|
| Section# | 2 | 4 | 6 | 8 | 10 | 12 |
| 39 | 235.7287 | 235.9535 | 235.9535 | 236.4031 | 236.6279 | 235.9535 |
| 40 | 235.7287 | 235.9535 | 235.9535 | 236.4031 | 236.6279 | 235.9535 |
| 41 | 235.5039 | 235.5039 | 235.9535 | 235.5039 | 235.5039 | 235.9535 |
| 42 | 235.5039 | 235.5039 | 235.9535 | 235.5039 | 235.5039 | 235.9535 |
| 43 | 235.2791 | 235.5039 | 235.2791 | 235.5039 | 235.5039 | 235.9535 |
| 44 | 235.2791 | 235.5039 | 235.2791 | 235.5039 | 235.5039 | 235.9535 |
| 45 | 235.0543 | 235.0543 | 235.2791 | 235.5039 | 235.5039 | 235.9535 |
| 46 | 235.0543 | 235.0543 | 235.2791 | 235.5039 | 235.5039 | 235.9535 |
| 47 | 234.8295 | 235.0543 | 235.2791 | 235.5039 | 235.5039 | 235.9535 |
| 48 | 234.8295 | 235.0543 | 235.2791 | 235.5039 | 235.5039 | 235.9535 |
| 49 | 234.6047 | 234.6047 | 234.6047 | 234.6047 | 235.5039 | 234.6047 |
| 50 | 234.6047 | 234.6047 | 234.6047 | 234.6047 | 235.5039 | 234.6047 |
| 51 | 234.3799 | 234.6047 | 234.6047 | 234.6047 | 234.3799 | 234.6047 |
| 52 | 234.3799 | 234.6047 | 234.6047 | 234.6047 | 234.3799 | 234.6047 |
| 53 | 234.1551 | 234.1551 | 234.6047 | 234.6047 | 234.3799 | 234.6047 |
| 54 | 234.1551 | 234.1551 | 234.6047 | 234.6047 | 234.3799 | 234.6047 |
| 55 | 233.9303 | 234.1551 | 233.9303 | 234.6047 | 234.3799 | 234.6047 |
| 56 | 233.9303 | 234.1551 | 233.9303 | 234.6047 | 234.3799 | 234.6047 |
| 57 | 233.7055 | 233.7055 | 233.9303 | 233.7055 | 234.3799 | 234.6047 |
| 58 | 233.7055 | 233.7055 | 233.9303 | 233.7055 | 234.3799 | 234.6047 |
| 59 | 233.4807 | 233.7055 | 233.9303 | 233.7055 | 234.3799 | 234.6047 |
| 60 | 233.4807 | 233.7055 | 233.9303 | 233.7055 | 234.3799 | 234.6047 |
| 61 | 233.2559 | 233.2559 | 233.2559 | 233.7055 | 233.2559 | 233.2559 |
| 62 | 233.2559 | 233.2559 | 233.2559 | 233.7055 | 233.2559 | 233.2559 |
| 63 | 233.0311 | 233.2559 | 233.2559 | 233.7055 | 233.2559 | 233.2559 |
| 64 | 233.0311 | 233.2559 | 233.2559 | 233.7055 | 233.2559 | 233.2559 |
| 65 | 232.8063 | 232.8063 | 233.2559 | 232.8063 | 233.2559 | 233.2559 |
| 66 | 232.8063 | 232.8063 | 233.2559 | 232.8063 | 233.2559 | 233.2559 |
| 67 | 232.5815 | 232.8063 | 232.5815 | 232.8063 | 233.2559 | 233.2559 |
| 68 | 232.5815 | 232.8063 | 232.5815 | 232.8063 | 233.2559 | 233.2559 |
| 69 | 232.3567 | 232.3567 | 232.5815 | 232.8063 | 233.2559 | 233.2559 |
| 70 | 232.3567 | 232.3567 | 232.5815 | 232.8063 | 233.2559 | 233.2559 |
| 71 | 232.1319 | 232.3567 | 232.5815 | 232.8063 | 232.1319 | 233.2559 |
| 72 | 232.1319 | 232.3567 | 232.5815 | 232.8063 | 232.1319 | 233.2559 |
| 73 | 231.9071 | 231.9071 | 231.9071 | 231.9071 | 232.1319 | 231.9071 |
| 74 | 231.9071 | 231.9071 | 231.9071 | 231.9071 | 232.1319 | 231.9071 |
| 75 | 231.6823 | 231.9071 | 231.9071 | 231.9071 | 232.1319 | 231.9071 |

(inches)

FIG. 9b

APPARATUS FOR REDUCING VSWR IN RIGID TRANSMISSION LINES

FIELD OF THE INVENTION

The present invention relates generally to rigid transmission lines and, more particularly, to a method and apparatus for reducing the voltage standing wave ratio in such transmission lines by dividing the transmission line into groups of equal-length sections.

BACKGROUND OF THE INVENTION

With the introduction of digital television and the fact that there are a limited number of towers for new broadcast antennas, there is now a need for multichannel antennas and transmission lines. These wide bandwidth devices allow several channels to share transmission facilities.

Rigid transmission lines are favored by the broadcast industry because of their wide bandwidth and durability. Rigid transmission lines historically have a large number of equal-length transmission line sections (generally 20 feet each) connected in series. These transmission lines couple transmitters, located in transmitter buildings, to their corresponding antennas which are on top of towers. Typically, the length of such a transmission line is from 200 to 2,000 feet. Such a transmission line generally comprises between 10 to 100 sections. Rigid transmission line systems are channelized, i.e., each television station has its own transmission line system designed for its broadcast channel. Channelized transmission line systems typically use 19.5, 19.75 or 20 foot sections. The section length is chosen to produce the optimum voltage standing wave ratio (VSWR) at the desired frequency.

A transmission line assembled from a plurality of equal-length sections requires a plurality of connector assemblies to join these sections together. However, these connector assemblies cause VSWR spikes. These spikes are caused by the in-phase addition of all the reflections from the connector assemblies. Such imperfect connector assemblies include bullets, bellows, dielectric supports (beads), flanges, etc. Thus, a transmission line having a plurality of equal-length sections will have VSWR spikes at each frequency where the section length is a multiple of $\lambda/2$, where $\lambda$ is the wavelength corresponding to the broadcast frequency. VSWR spikes are narrow ranges of frequency where the VSWR is too high for the transmission line to work properly. These spikes occur at intervals of 24.6 MHz for 20-foot sections. The spikes restrict the operating bandwidth to something less than the spike separation. Until the late 1950's, the only way to improve the wide band VSWR performance of rigid transmission lines was to improve the reflection coefficient of the connector assemblies. This reduced the size of the spikes.

A paper entitled "The Optimum Spacing of Bead Supports in Coaxial Line at Microwave Frequencies" by David Dettinger, 1957 IRE Convention Record; Vol. 5, part I, pp. 250–253 and U.S. Pat. No. 5,455,548 disclose another way to reduce VSWR spikes. The Dettinger paper discloses progressively varying the distance between bead supports so that the reflections from those beads do not add in phase. U.S. Pat. No. 5,455,548 discloses a subtle twist on the Dettinger paper. That patent discloses varying the length of the sections in such a way that the reflections from the connector assemblies do not add in-phase. Reducing the spikes in this manner requires each section of the rigid transmission line to be a different length. The length of each section is determined by the following formula:

$$l = L + \frac{\lambda(n-1)}{2N}, n = 1 \text{ to } N$$

where l=the length of section n,

L=the nominal section length,

N=the number of sections, n=the section number, and $\lambda$=the wavelength corresponding to a selected frequency within a band of frequencies.

The above formula results in a progression of section lengths, i.e., each section is progressively longer in length than the preceding section.

Wide band transmission lines with reduced VSWR are advantageous. However, the concept of progressively increasing section lengths is cumbersome. Because each section of the transmission line has a different length, each section must be appropriately labeled, for example, with a section number. Installation of these sections is a time consuming exercise that requires locating and identifying each section and assembling the sections in sequence. Furthermore, each shipping container must be large enough to hold the longest section and must have packaging that accommodates all the different size sections. Even after this transmission line is assembled, upkeep and maintenance are a problem. For example, the only way a broadcast transmission facility can keep the correct length replacement section on site is if an entire transmission line system is kept in reserve. Such a solution is costly and causes an additional problem: the sections kept on site as replacement parts are easily damaged during storage. As an alternative solution, a transmission facility may store standard length sections that require their being cut to the required length on site. Or, the facility must identify the section number needing replacement and have the maker of the transmission line system send that specific section to the transmission facility. Meanwhile, even if the section is sent overnight, the broadcast facility is still off the air in the interim.

The present transmission line system is designed to overcome these problems.

SUMMARY OF THE INVENTION

A rigid, coaxial transmission line is provided which includes a plurality of sections joined by connector assemblies. The transmission line includes a plurality of ordered groups. Each of the ordered groups includes a plurality of equal-length sections. The length of the equal-length sections in each ordered group is selected to reduce the VSWR spikes caused by the connector assemblies. The length of the equal-length sections progressively changes between each of the ordered groups.

BRIEF DESCRIPTION OF THE DRAWINGS

FIGS. 9*a* and 9*b* are a table giving the section lengths of transmission lines having a varying number of sections per group;

DESCRIPTION OF ILLUSTRATIVE EMBODIMENTS

Figure 1:
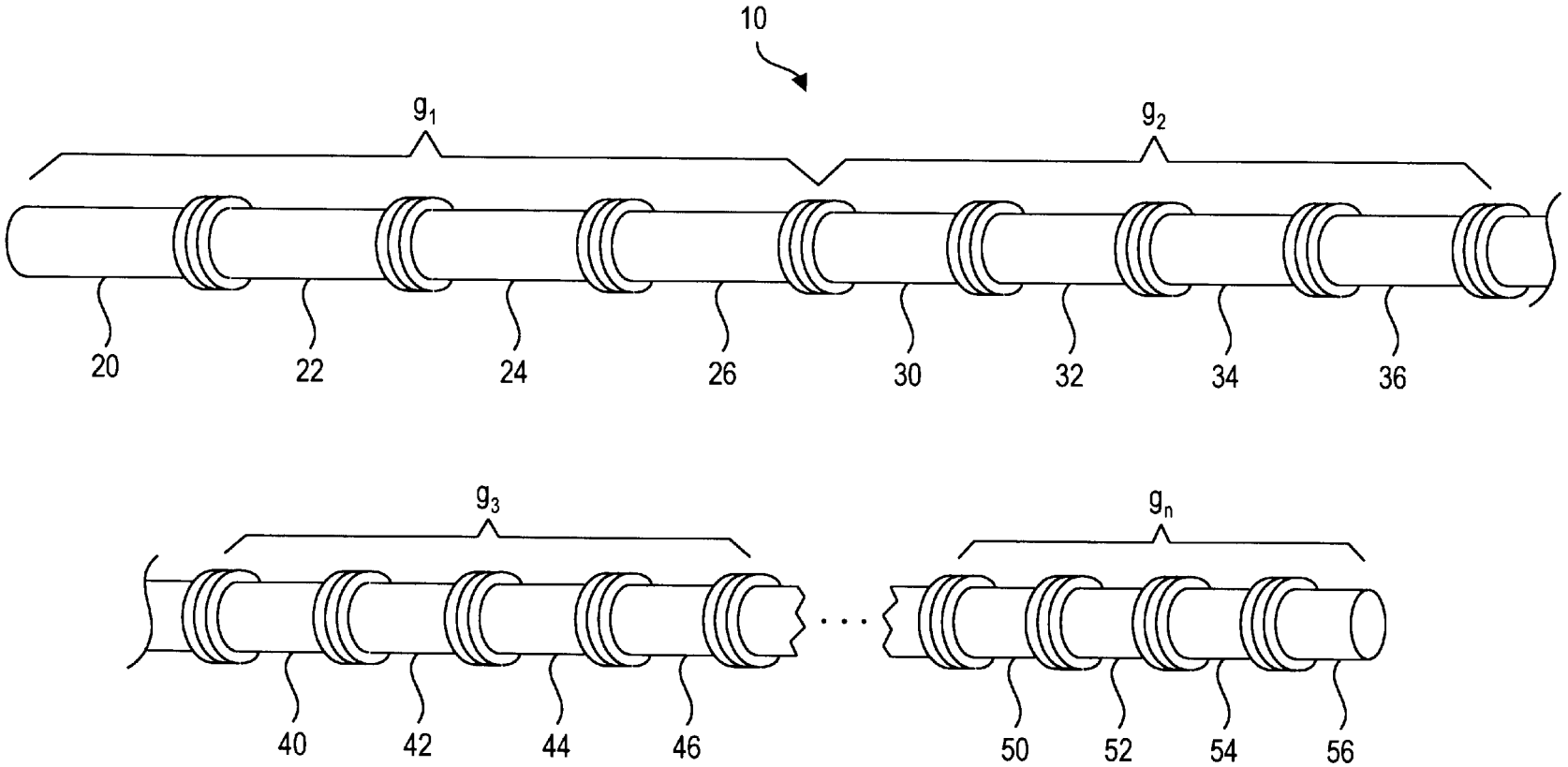
FIG. 1 is a perspective view of a transmission line according to the present invention.

As illustrated in FIG. 1, a transmission line 10 is divided into groups $g_1$, $g_2$, . . . $g_n$, each group including an equal number of sections. For instance, group $g_1$ includes sections 20, 22, 24 and 26; group $g_2$ includes sections 30, 32, 34 and 36; group $g_3$ includes sections 40, 42, 44 and 46; group $g_n$ includes sections 50, 52, 54 and 56. All sections in each group are equal in length. For example, the four sections 20, 22, 24 and 26 in group gi are equal in length. Sections in different groups have different lengths, e.g., section 26 is longer in length than adjacent section 30. To assemble the transmission line 10, the ordered groups $g_1$, $g_2$, . . . $g_n$ are assembled in a predetermined order. However, the sections within each group may be joined in any order because they are interchangeable. This simplifies assembly and insures that only one section from each group is required for on site replacement. Section labeling is also simpler because all the sections in a group have the same part number. Manufacturing costs arc reduced by limiting the number of cutoff saw setups, labels, inventory controls, packaging materials, etc. to the number of groups required for the transmission line.

Computer calculations show that a 1,500-foot transmission line can comprise from 2 to 12 sections per group without substantial VSWR degradation. The VSWR performance of the transmission line gradually degrades as the number of sections per group increases. For example, the VSWR for a transmission line having groups of 12 sections is 1.077:1. However, reducing the number of sections per group will decrease the VSWR and thereby improve the performance of the transmission line.

The length of the sections in each group may be determined from the following formula:

$$l_s(g) = L_s - (g-1)\frac{N_s}{N_T}\frac{\lambda_H}{2},\ g = 1 \text{ to } G \tag{1}$$

where $l_s(g)$=the length of a section in group g, $L_s$=the starting section length, $L_T$=the total length of rigid transmission line, $N_s$=the number of sections in group g, $N_T$=the total number of sections $$\cong \frac{L_T}{L_s - \frac{\lambda_H}{4}},$$

$\lambda_H$=a wavelength that corresponds to a frequency near the highest frequency for which the transmission line was designed, g=the group number, and G=the number of groups<number of sections.

Alternatively, the length of the sections in each group may be determined from the following formula:

$$l_s(g) = L_s + (g-1)\frac{N_s}{N_T}\frac{\lambda_H}{2},\ g = 1 \text{ to } G \tag{2}$$

where $l_s(g)$=the length of a section in group g, $L_s$=the starting section length, $L_T$=the total length of rigid transmission line, $N_s$=the number of sections in group g, $N_T$=the total number of sections $$\cong \frac{L_T}{L_s + \frac{\lambda_H}{4}},$$

$\lambda_H$=a wavelength that corresponds to a frequency near the highest frequency for which the transmission line is designed, g=the group number, and G=the number of groups<number of sections.

Equation (1) is used to calculate the longest section first, then the next longest section and so on. Equation (2) is used to calculate the shortest section first, then the next shortest section and so on. The two equations produce similar results. The groups are assembled in numerical order by group number g. The number of sections in a group $N_s$ is chosen to give the desired VSWR. For example, having 2 to 12 sections per group has been found to produce an acceptable VSWR. As mentioned above, the VSWR performance of a transmission line gradually degrades as the number of sections per group is increased, i.e., as the number of sections per group increases so does the VSWR. $\lambda_H$ is a wavelength that corresponds to a frequency near the highest frequency for which the transmission line is designed, which is typically plus or minus 10 percent of the highest frequency that the transmission line is designed to accommodate. In one embodiment, the frequency corresponding to $\lambda_H$ is between 650 and 750 MHz. If the starting section length $L_s$ is arbitrarily chosen, for example, to be 20 feet, the resulting length of the transmission line may not be an integral number of groups. If this is the case, after the last complete group, an additional number of individual section(s) is either added (equation (1)) or subtracted (equation (2)) and, if required, a partial section is added to complete the transmission line. This only minimally increases the VSWR performance of the resulting transmission line.

Alternatively, the length of the sections in each group may be determined from equation (1) or equation (2) where $N_T$=the total number of sections $$\cong \frac{L_T}{L_s}.$$

In this embodiment, the total number of sections is only increased or decreased by approximately one section. However, this alternative embodiment still produces acceptable VSWR results.

Figure 2:
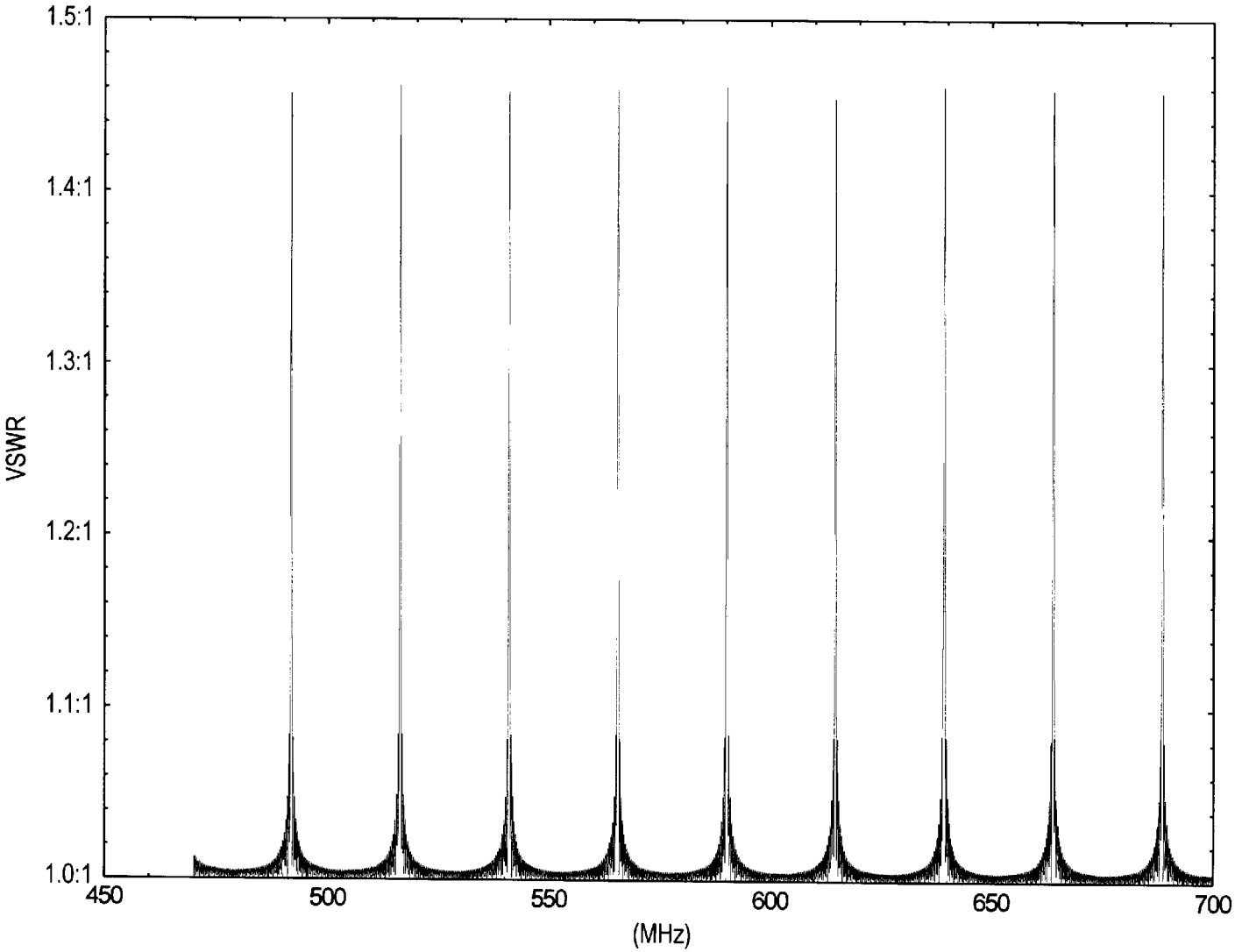
FIG. 2 Prior Art
FIG. 2 is a graph illustrating the VSWR performance of a prior art transmission line.

FIGS. 2–8 illustrate computer calculations of the VSWR of seven different transmission lines. Each of the seven transmission lines is terminated with a perfect load and has a connector reflection coefficient of 0.0025 (−52 dB return loss). Each of the seven transmission lines has a design bandwidth of between 470 and 700 MHz. The VSWR of a prior art standard rigid transmission line is illustrated in FIG. 2. The results of FIG. 2 are estimated values for a commercially available 8⅜ inch "MACXLine"® coaxial transmission line manufactured by Andrew Corporation of Orland Park, Ill. The results of FIG. 2 are based on a transmission line that includes 75 sections each having a length of 20 feet, thus producing a 1,500-foot transmission line. FIG. 2 shows the VSWR spikes produced by this standard-construction, rigid, coaxial line having equal-length sections joined by standard connector assemblies. The reflection coefficient of the spikes $R_{cs}$ can be calculated from the number of spikes S times the connector reflection coefficient $R_{cc}$ (i.e., $R_{cs}=S\times R_{cc}$) In the illustrated embodiment, $R_{cs}=75\times 0.0025=0.1875$. This value translates to a VSWR of 1.46:1, as shown in FIG. 2.

The type of transmission line that the present invention is adapted for is a rigid, coaxial transmission line. One type of such transmission line includes a rigid outer conductor and a bellowed inner conductor that is insulated from the outer conductor by a dielectric support or bead. The details of a bellowed inner conductor coaxial line are described in U.S. Pat. No. 4,543,548, which is assigned to the assignee of the present application and is incorporated herein by reference in its entirety.

Figure 3:
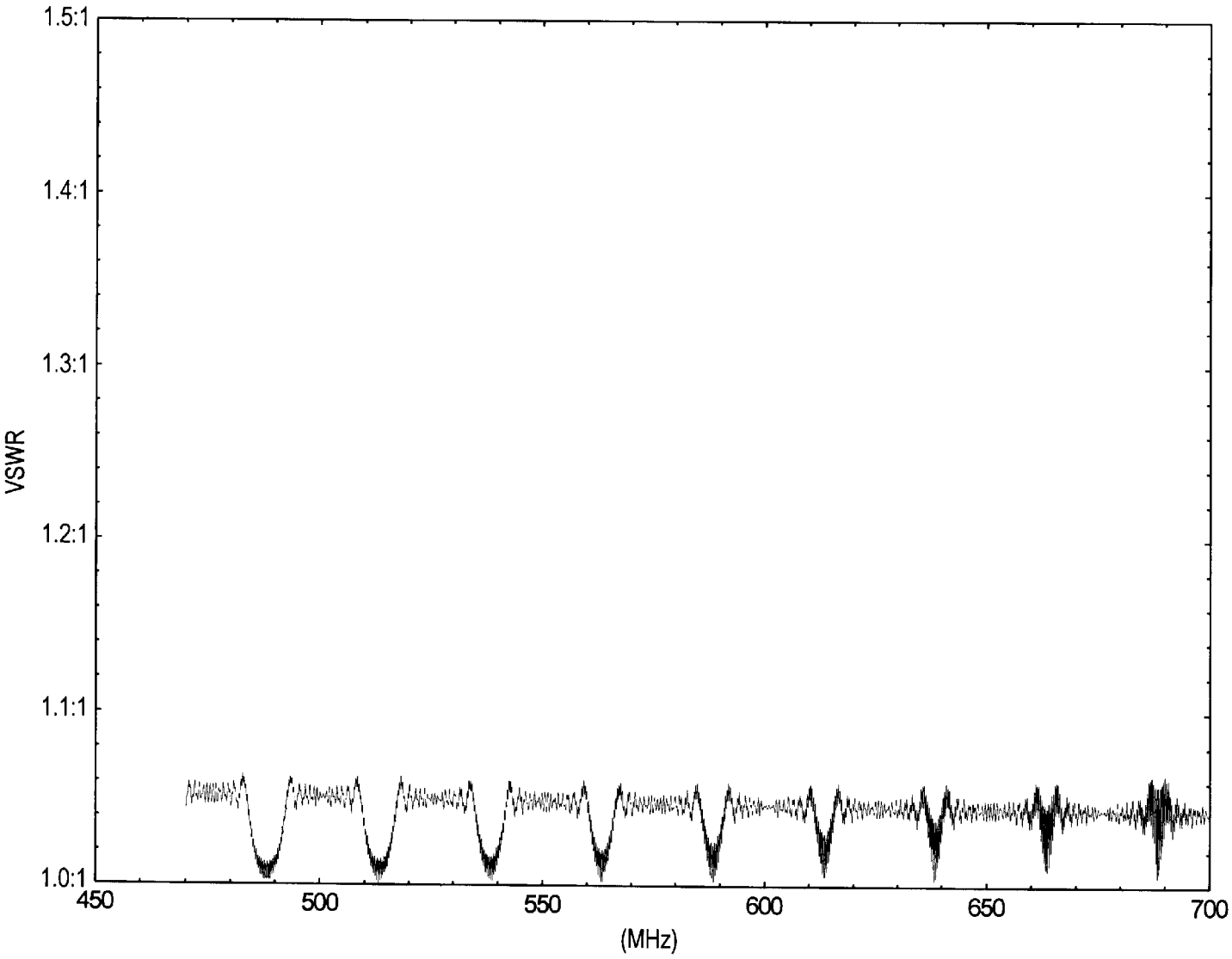
FIG. 3 is a graph illustrating the VSWR performance of a transmission line according to one embodiment of the present invention.
Figure 4:
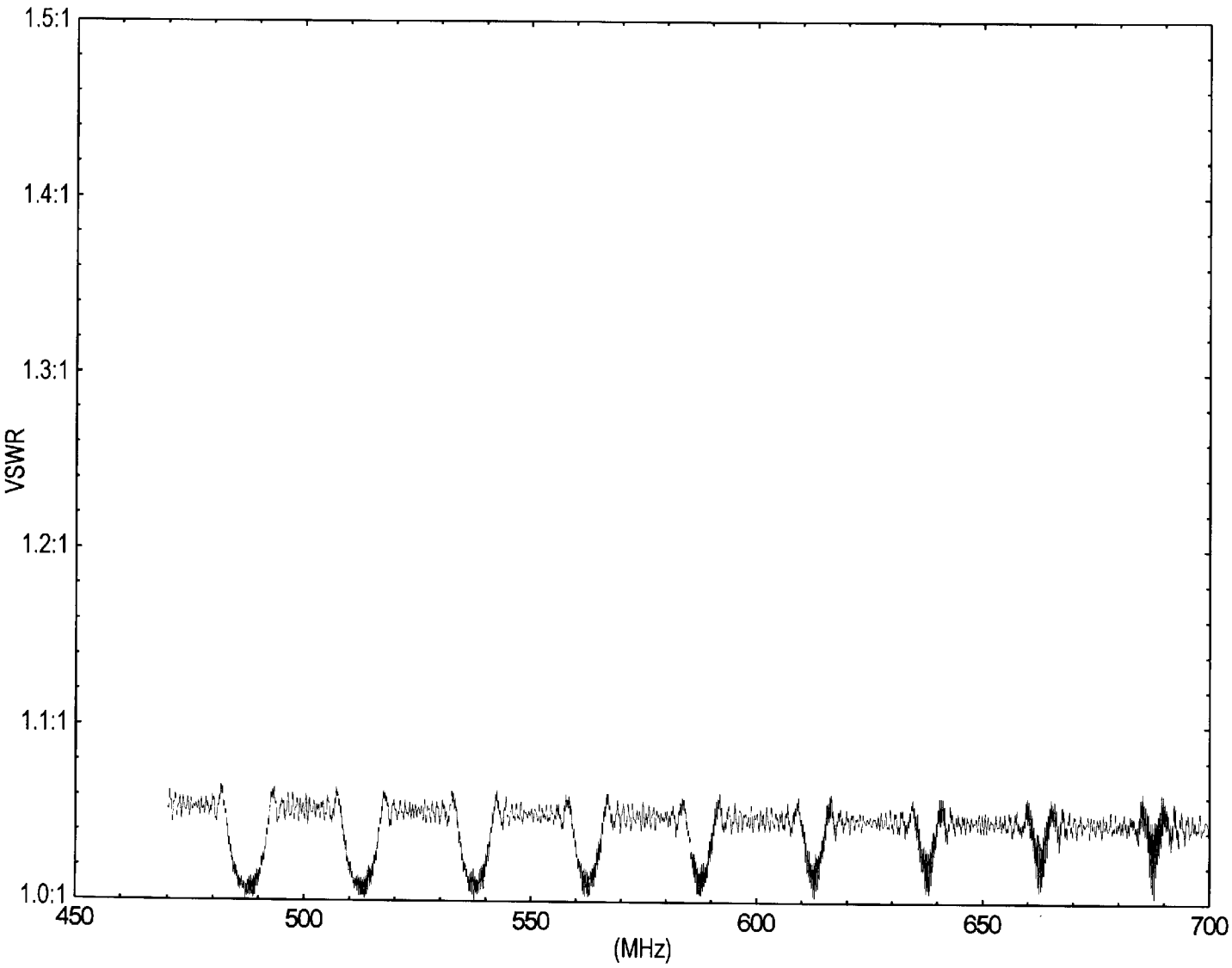
FIG. 4 is a graph illustrating the VSWR performance of a transmission line according to another embodiment of the present invention.
Figure 5:
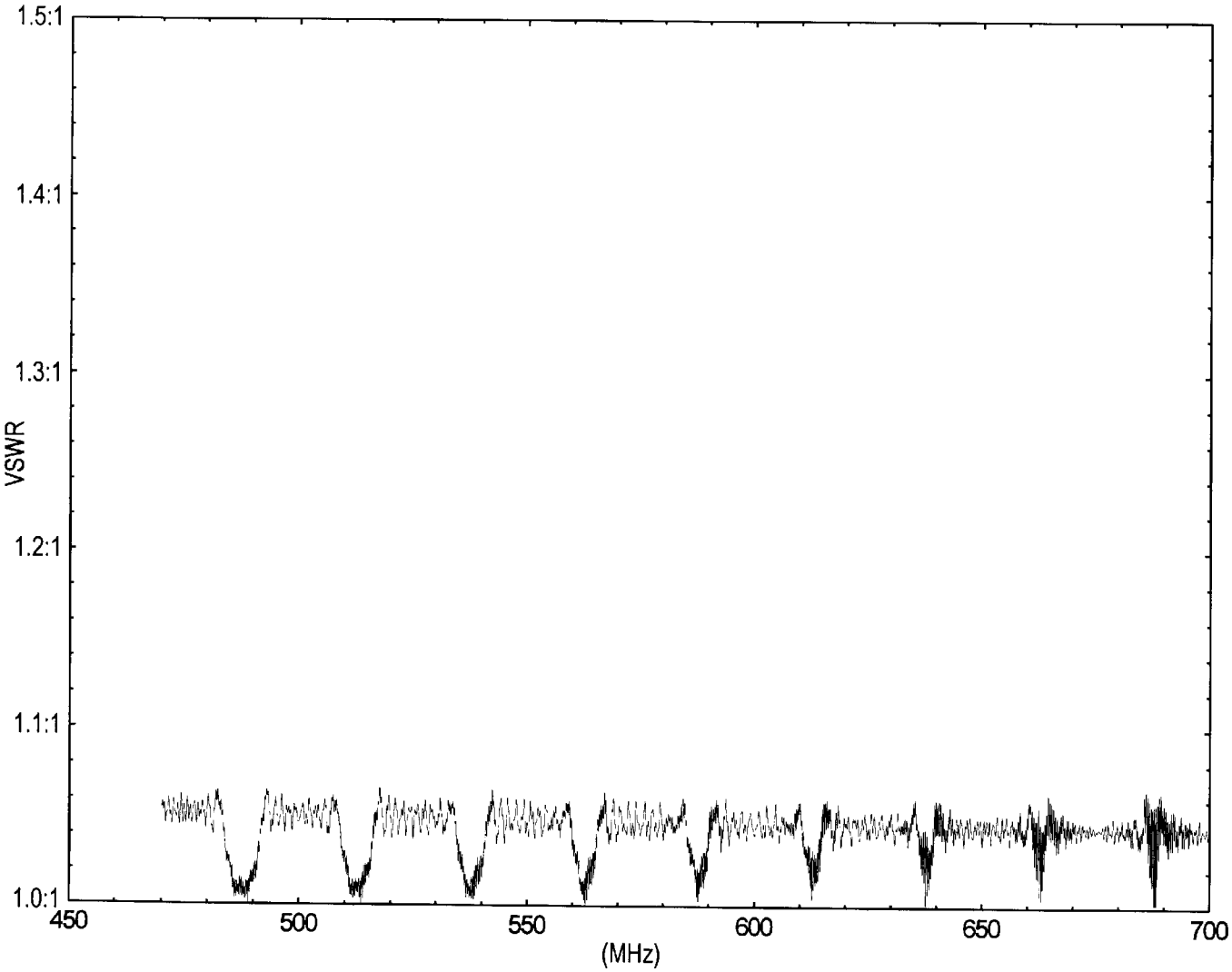
FIG. 5 is a graph illustrating the VSWR performance of a transmission line according to a further embodiment of the present invention.

FIGS. 3–8 illustrate the calculated VSWR of a rigid, coaxial transmission line according to one embodiment of the present invention. FIG. 3 illustrates the VSWR of a transmission line that includes 37 groups each having 2 sections and an additional section for a total of 75 sections equaling approximately 1,500 feet. FIG. 4 illustrates the VSWR of a transmission line that includes 18 groups each having 4 sections and an additional three sections for a total of 75 sections equaling approximately 1,500 feet. FIG. 5 illustrates the VSWR of a transmission line that includes 12 groups each having 6 sections and an additional three sections for a total of 75 sections equaling approximately 1,500 feet.

Figure 6:
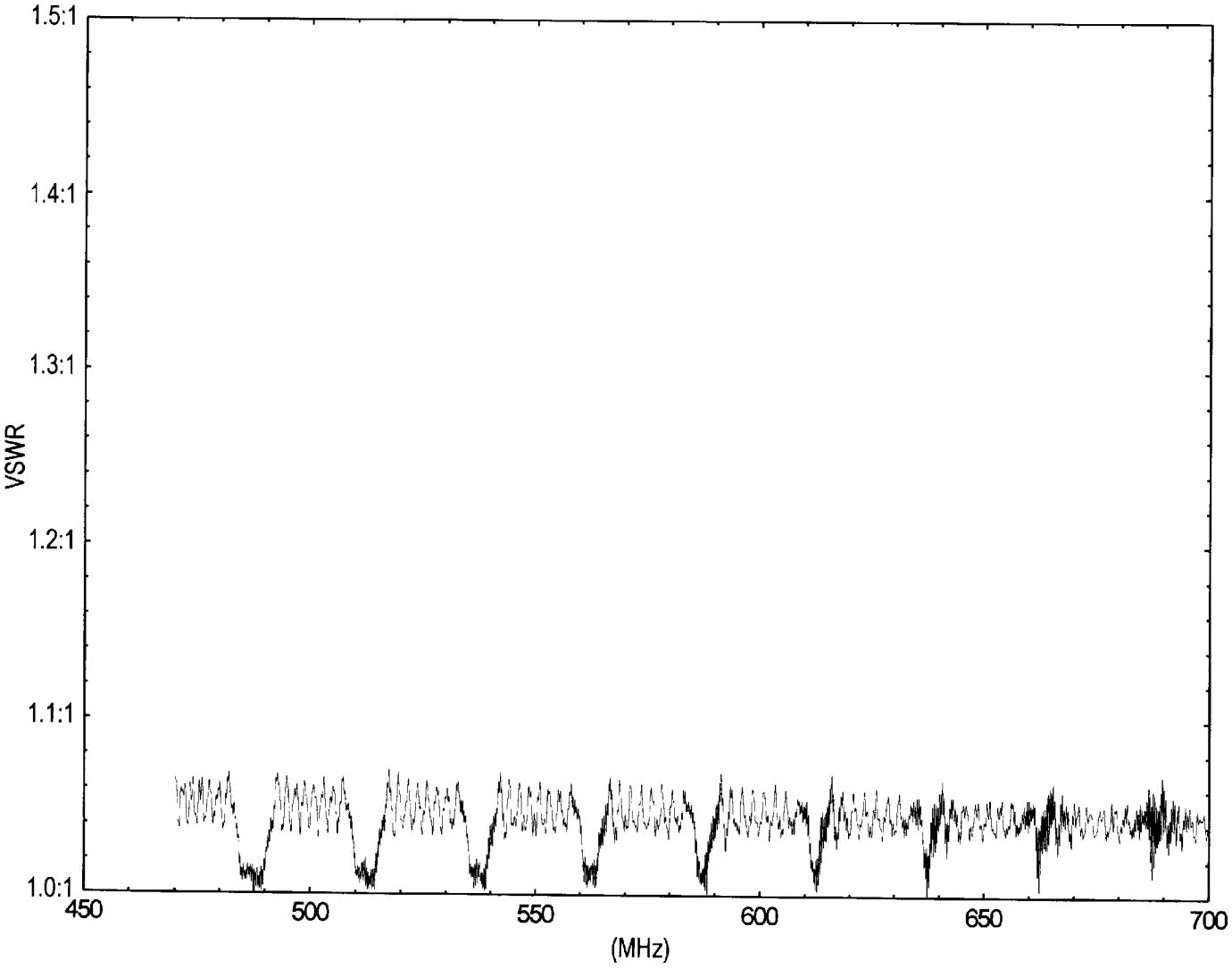
FIG. 6 is a graph illustrating the VSWR performance of a transmission line according to still another embodiment of the present invention.
Figure 7:
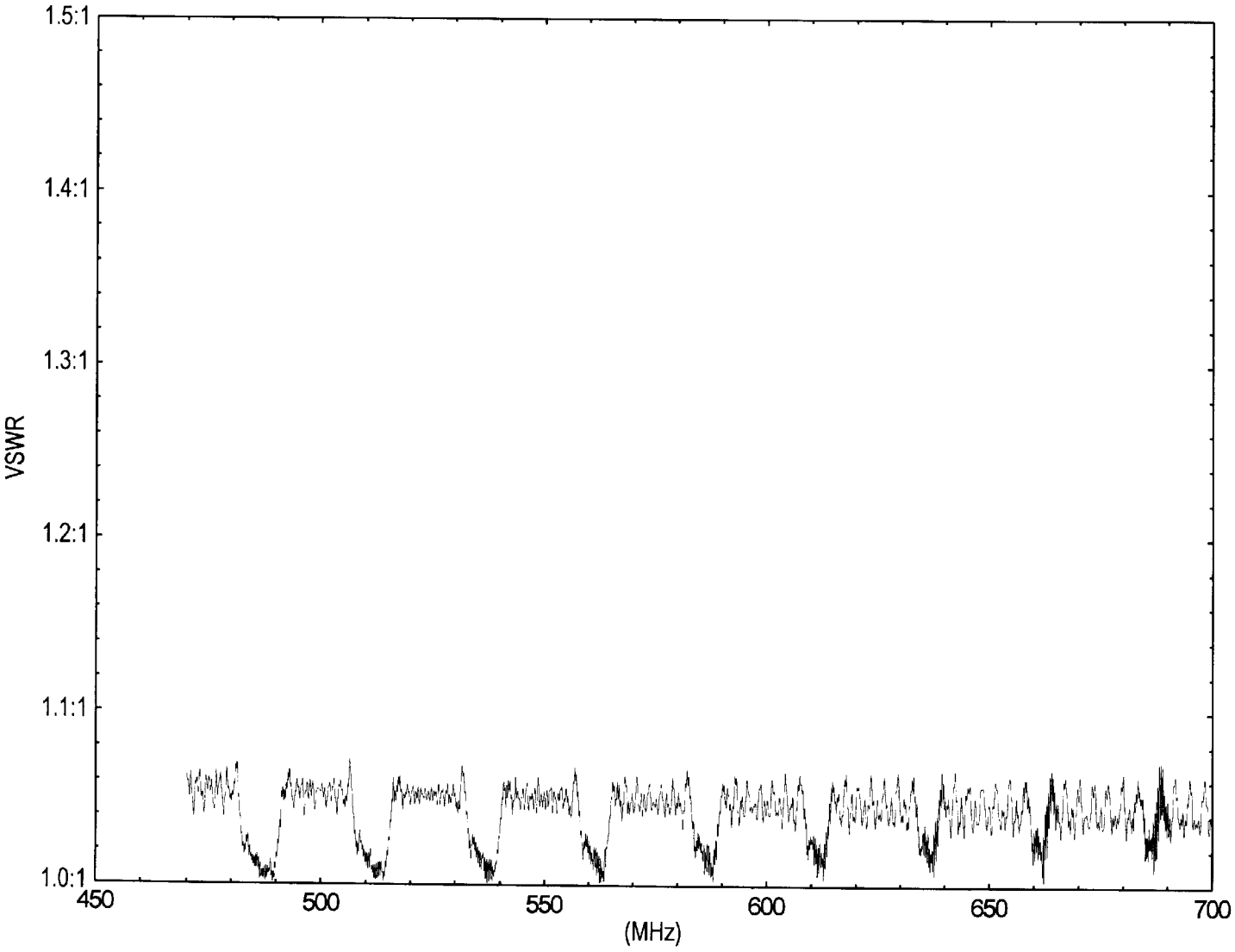
FIG. 7 is a graph illustrating the VSWR performance of a transmission line according to a further embodiment of the present invention.
Figure 8:
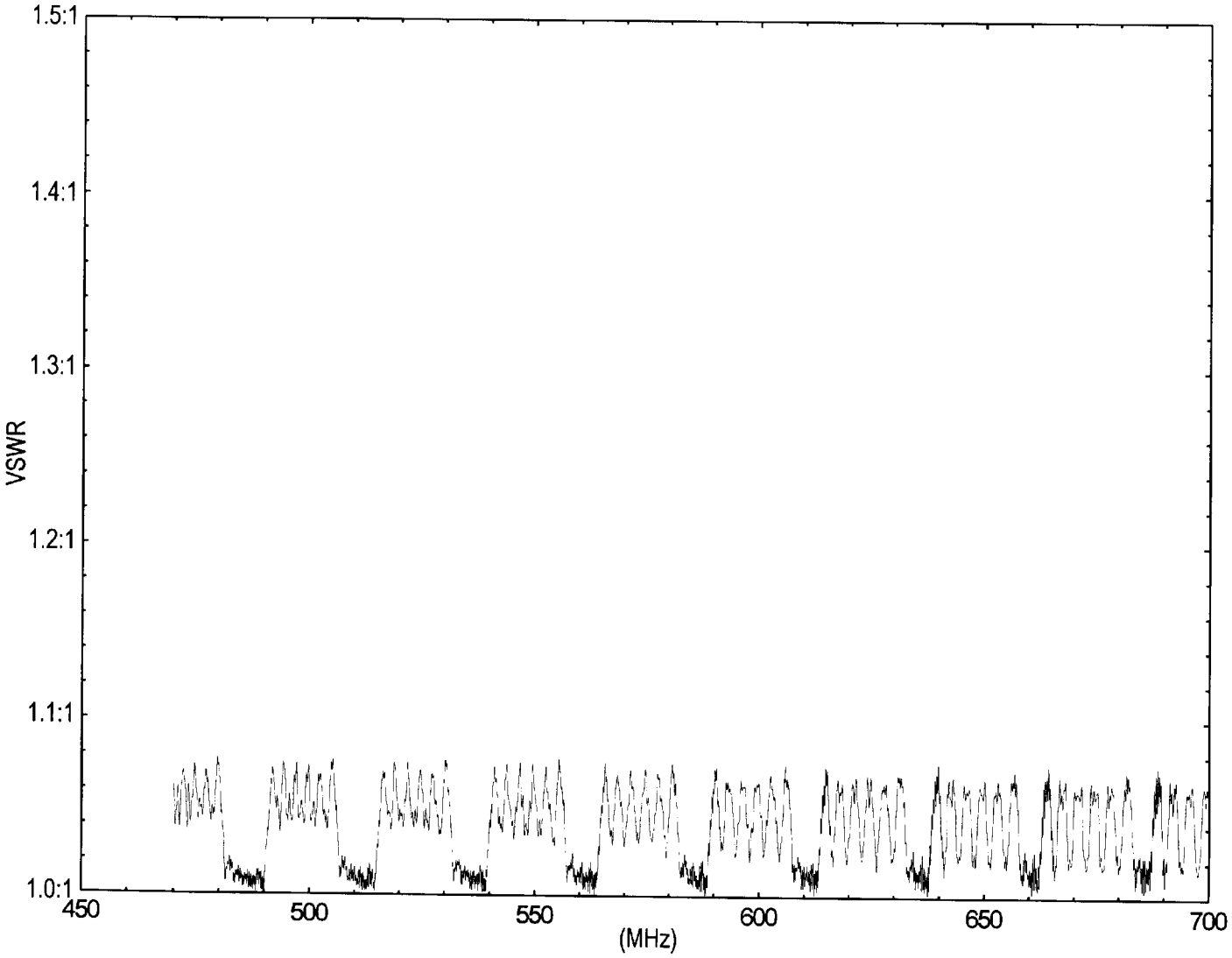
FIG. 8 is a graph illustrating the VSWR performance of a transmission line according to another embodiment of the present invention.

FIG. 6 illustrates the VSWR of a transmission line that includes 9 groups each having 8 sections and an additional three sections for a total of 75 sections equaling approximately 1,500 feet. FIG. 7 illustrates the VSWR of a transmission line that includes 7 groups each having 10 sections and an additional five sections for a total of 75 sections equaling approximately 1,500 feet. FIG. 8 illustrates the VSWR of a transmission line that includes 6 groups each having 12 sections an additional three sections for a total of 75 sections equaling approximately 1,500 feet. FIGS. 3–8 each include 75 sections so that the maximum possible VSWR is the same as in FIG. 2.

The data from FIGS. 3–8 is based on transmission lines with the section lengths given in the table of FIG. 9. There, the length of each section in each group is shown. The number of sections per group is across the top of the table, and the section number is down the first column. FIG. 3 corresponds to the 2 sections per group column. FIG. 4 corresponds to the 4 sections per group column. FIG. 5 corresponds to the 6 sections per group column. FIG. 6 corresponds to the 8 sections per group column. FIG. 7 corresponds to the 10 sections per group column. And FIG. 8 corresponds to the 12 sections per group column.

FIGS. 3–8 show that if the section lengths are made unequal, by the method of the present invention, the VSWR is reduced in the region of the original VSWR spikes but is increased in the regions between the original spikes. Having a substantially equal number of equal length sections per group produces a VSWR that is substantially constant in magnitude. For example, FIG. 6 illustrates the VSWR of a transmission line that includes groups having 8 sections per group. Thus, for example, the VSWR envelopes around the frequencies 500, 525, 550, 575, 600, 625, 650 and 675 MHz are all substantially constant in magnitude. If, however, one group had a different number of sections or had several sections with a length different than the rest of the sections in that group, then VSWR degradation will occur, i.e., the VSWR will increase.

For example, if one group of the transmission line has a different number of sections, such as 5 sections rather than 8 sections, then the VSWR envelopes would be substantially constant at a greater VSWR magnitude. For the present example, the VSWR would increase from about 1.07:1 to 1.085:1. If one group of the transmission line has several sections, such as 3 sections, with a length different than the rest of the sections in that group, then the VSWR envelopes would each be greater in magnitude. For the present example, the VSWR would increase from about 1.07:1 to 1.08:1. If the different length sections were the same length as sections in other groups, small VSWR "spikes" may start to form in most of the waveforms. If, however, one group of the transmission line has one section with a length different than the rest of the sections in that group, then the VSWR envelopes would not be greatly effected, i.e., each envelope would only increase slightly in VSWR magnitude.

Figure 10:
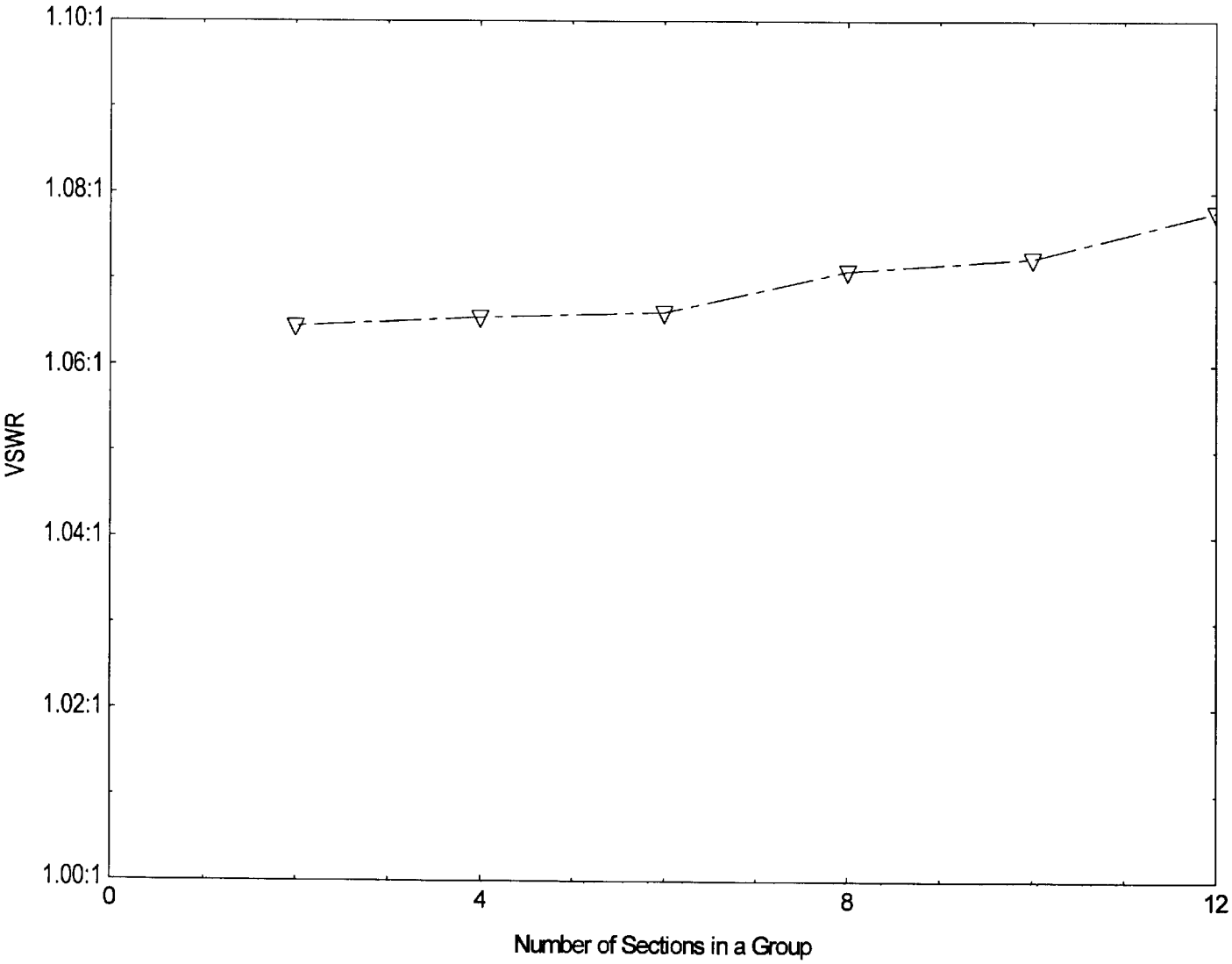
FIG. 10 is a graph illustrating the VSWR performance of the present invention when the number of sections in a group is varied.
Figure 11:
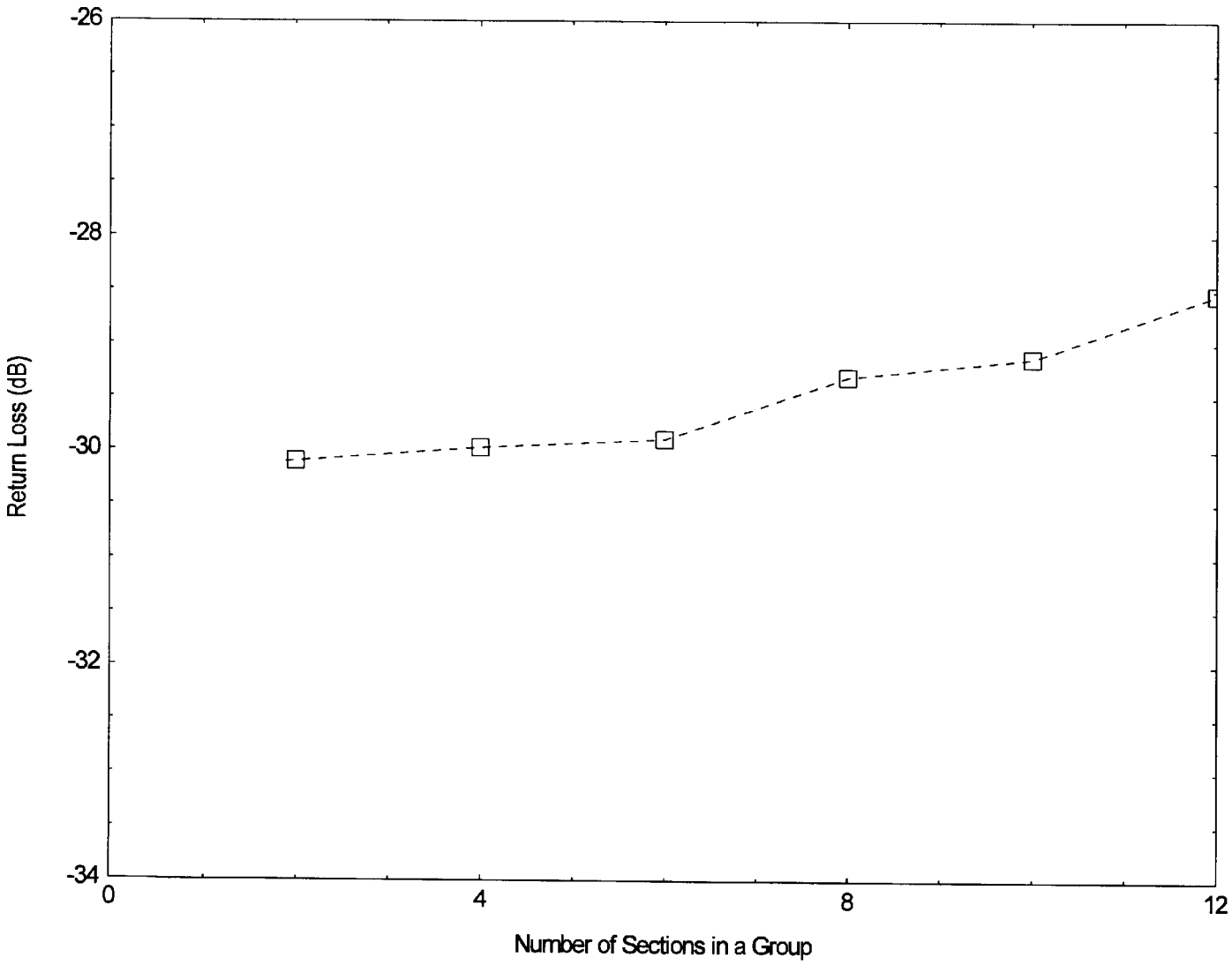
FIG. 11 is a graph illustrating the return loss performance of the present invention when the number of sections in a group is varied.

FIG. 10 shows the worse case VSWR performance verses the number of sections in a group for a 1,500-foot transmission line. FIG. 11 shows the same data as FIG. 10 only the data in FIG. 11 is expressed as return loss. As FIG. 10 illustrates, the VSWR increases as the number of sections in a group is increased. Thus, for optimal performance, a smaller number of sections per group is desirable. However, from a cost efficiency standpoint, a larger number of identical length sections per group is desirable. Therefore, the present invention is a compromise that divides a transmission line into groups having, for example, between 2 and 12 equal-length sections per group. This technique provides a cost effective transmission line with only a minimal decrease in performance versus a transmission line comprised of all different length sections. Accordingly, the present invention decreases the cost of producing, installing and maintaining a transmission line because significantly fewer section sizes are required.

While the present invention has been described with reference to one or more preferred embodiments, those skilled in the art will recognize that many changes may be made thereto without departing from the spirit and scope of the present invention which is set forth in the following claims.

What is claimed is:

1. A rigid, coaxial transmission line that is divided into groups, each group including a plurality of sections each having a substantially equal-length, the sections being connected in series by connector assemblies that cause VSWR spikes, the length $l_s(g)$ of the sections in a group g being given essentially according to the formula:

$$l_s(g) = L_s + (g-1)\frac{N_s}{N_T}\frac{\lambda_H}{2}, \text{ for } g = 1 \text{ to } G$$

where $l_s(g)$=the length of a section in group g, $L_s$=the starting section length, $L_T$=the total length of rigid transmission line, $N_s$=the number of sections in group g, $N_T$=the total number of sections $$\cong \frac{L_T}{L_s + \frac{\lambda_H}{4}},$$

$\lambda_H$=a wavelength that corresponds to a frequency near the highest frequency for which the transmission line was designed, g=the group number, and G=the number of groups<number of sections.

2. The transmission line of claim 1, wherein said rigid, coaxial transmission line includes an outer conductor and an inner conductor, said inner conductor being insulated from said outer conductor by a dielectric support.

3. The transmission line of claim 1, wherein $\lambda_H$ is between 18.2 and 15.8 inches.

4. The transmission line of claim 1, wherein said rigid, coaxial transmission line is divided into groups each having a substantially equal number of sections.

5. A rigid, coaxial transmission line that is divided into groups, each group including a plurality of sections each having a substantially equal-length, the sections being connected in series by connector assemblies that cause VSWR spikes, the length $l_s(g)$ of the sections in a group g being given essentially according to the formula:

$$l_s(g) = L_s - (g-1)\frac{N_s}{N_T}\frac{\lambda_H}{2}, \text{ for } g = 1 \text{ to } G$$

where $l_s(g)$=the length of a section in group g, $L_s$=the starting section length, $L_T$=the total length of rigid transmission line, $N_s$=the number of sections in group g, $N_T$=the total number of sections $$\cong \frac{L_T}{L_s - \frac{\lambda_H}{4}},$$

$\lambda_H$=a wavelength that corresponds to a frequency near the highest frequency for which the transmission line was designed, g=the group number, and G=the number of groups<number of sections.

6. The transmission line of claim 5, wherein said rigid, coaxial transmission line includes an outer conductor and an inner conductor, said inner conductor being insulated from said outer conductor by a dielectric support.

7. The transmission line of claim 5, wherein $\lambda_H$ is between 18.2 and 15.8 inches.

8. The transmission line of claim 5, wherein said rigid, coaxial transmission line is divided into groups each having a substantially equal number of sections.

9. A rigid, coaxial transmission line including a plurality of sections, joined by connector assemblies, the transmission line comprising:

a plurality of ordered groups, each of said ordered groups including a plurality of substantially equal-length sections, the length of said substantially equal-length sections being selected to reduce the VSWR spikes caused by the connector assemblies, the length of said substantially equal-length sections progressively changing between each pair of said ordered groups.

10. The transmission line of claim 9, wherein each of said ordered groups has a substantially equal number of sections.

11. The transmission line of claim 9, wherein said length of said equal-length sections progressively changes by progressively decreasing.

12. The transmission line of claim 9, wherein said length of said equal-length sections progressively changes by progressively increasing.

13. The transmission line of claim 9, wherein said length of said equal-length sections progressively changes essentially according to the formula:

$$l_s(g) = L_s - (g-1)\frac{N_s}{N_T}\frac{\lambda_H}{2}, \text{ for } g = 1 \text{ to } G$$

where $l_s(g)$=the length of a section in group g, $L_s$=the starting section length, $L_T$=the total length of rigid transmission line, $N_s$=the number of sections in group g, $N_T$=the total number of sections $$\cong \frac{L_T}{L_s},$$

$\lambda_H$=a wavelength that corresponds to a frequency near the highest frequency for which the transmission line was designed, g=the group number, and G=the number of groups<number of sections.

14. The transmission line of claim 13, wherein $N_T$ $$\cong \frac{L_T}{L_s - \frac{\lambda_H}{4}}.$$

15. The transmission line of claim 9, wherein said length of said equal-length sections progressively changes essentially according to the formula:

$$l_s(g) = L_s + (g-1)\frac{N_s}{N_T}\frac{\lambda_H}{2}, \text{ for } g = 1 \text{ to } G$$

where $l_s(g)$=the length of a section in group g, $L_s$=the starting section length, $L_T$=the total length of rigid transmission line, $N_s$=the number of sections in group g, $N_T$=the total number of sections $$\cong \frac{L_T}{L_s},$$

$\lambda_H$=a wavelength that corresponds to a frequency near the highest frequency for which the transmission line was designed, g=the group number, and G=the number of groups<number of sections.

16. The transmission line of claim 15, wherein $N_T$ $$\cong \frac{L_T}{L_s + \frac{\lambda_H}{4}}.$$

* * * * *